United States Patent [19]

Lacroix

[11] 4,019,856

[45] Apr. 26, 1977

[54] OIL LAMP

[76] Inventor: Jean R. Lacroix, 167 bis, Avenue Victor Hugo, 75116 - Paris, France

[22] Filed: Sept. 15, 1975

[21] Appl. No.: 613,539

[30] Foreign Application Priority Data

Oct. 22, 1974 France ..... 74.35445

[52] U.S. Cl. ..... 431/298; 431/320

[51] Int. Cl.[2] ..... F23D 3/02

[58] Field of Search ..... 431/298, 320, 299

[56] References Cited

UNITED STATES PATENTS

| | | | |
|---|---|---|---|
| 756,322 | 4/1904 | Boersig | 431/320 |
| 3,183,688 | 5/1965 | Sobelson | 431/298 |
| 3,434,789 | 3/1969 | Haller | 431/298 |
| 3,790,332 | 2/1974 | Woolard | 431/298 |
| 3,840,113 | 10/1974 | Bartleson | 206/232 |

FOREIGN PATENTS OR APPLICATIONS

| | | | |
|---|---|---|---|
| 3,786 | 7/1891 | Germany | 431/298 |

*Primary Examiner*—Carlton R. Croyle
*Assistant Examiner*—Thomas I. Ross
*Attorney, Agent, or Firm*—Larson, Taylor & Hinds

[57] ABSTRACT

An oil lamp comprising a container containing a layer of oil on top of an incombustible liquid and at least one float in which is fitted at least one wick, wherein each float is arranged so as to rest on the oil-incombustible liquid interface, each wick having an initial length which is greater than the depth of the layer of oil so that in the floating position the said wick emerges from the said layer.

11 Claims, 2 Drawing Figures

OIL LAMP

FIELD OF THE INVENTION

The invention relates to an oil lamp of the floating flame type.

THE PRIOR ART

These lamps, which are used in particular for decorative purposes (for example for decorating tables, in private apartments, in restaurants or in any other places) often consist of a glass or vase containing a layer of oil floating on top of a layer of water or other liquid which is optionally coloured, and on the layer of oil rests a float carrying a wick which is thus continuously moistened by the oil or other substance able to support combustion of a flame.

The known solutions give rise to certain disadvantages. First of all, it should be noted that on account of the shape of the float the layer of oil is not always completely exhausted when the flame dies out. Furthermore, when the wick starts to become extinguished, generally with the formation of soot, the float is damaged.

The invention is directed to providing an arrangement which obviates at least some of these disadvantages.

SUMMARY OF THE INVENTION

According to the invention there is provided an oil lamp comprising a container containing a layer of oil on top of an incombustible liquid and at least one float in which is fitted at least one wick, wherein each float is arranged so as to rest on the oil-incombustible liquid interface, each wick having an initial length which is greater than the depth of the layer of oil so that in the floating position the said wick emerges from the said layer.

This float may have (although it need not have) a relatively thin cross-section so that almost all the layer will be consumed by combustion by simple means.

The initial length of the wick is of course calculated so that the wick emerges from the oil layer at the start of combustion.

If furthermore, in accordance with a preferred embodiment, the wick passes through the float and thus into the layer of incombustible liquid, the flame automatically extinguishes as soon as the layer of oil starts to decrease in thickness. In fact, during the combustion it is the oil which soaks the wick whereas the water, which is heavier, remains at the inlet of the wick. On the other hand, towards the end of combustion when the thickness of the layer of oil tends towards zero, the water feeds the wick and thus automatically extinguishes the flame without there being any danger of the flame damaging the float.

At least one hole or other breach may be provided in the float close to the wick, e.g. around the foot of the wick to facilitate access of the last drops of oil to the wick, though in practice it has been found that this is not absolutely necessary.

The float advantageously has a dished shape e.g. like a thin calotte or cup of fairly large radius which, as is found in practice, rests in a stable manner on the interface between the water and oil and prevents air bubbles appearing under the float.

Finally, if this calotte is made of a transparent material (for example a plastics material), an arrangement is created in which the float remains invisible and the flame all the time appears to be suspended above the surface of the oil. This is particularly true in the case of a calotte which prevents air bubbles appearing.

However, the invention of course also covers floats of any other shape, even flat floats, which remain permanently on the interface between the two liquids.

The invention is aimed more particularly at certain methods of application as well as certain embodiments of the above-indicated arrangements and includes even more especially and as new industrial products, lamps of the type in question utilising these same arrangements, as well as the special units adapted for installing these arrangements, and sets using similar devices or lamps.

The invention will in any case be better understood with the help of the following description and accompanying drawings, which are of course given purely by way of example.

DESCRIPTION OF EMBODIMENTS

Figure 2:
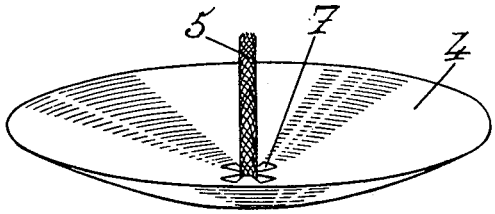
FIG. 2 shows separately, and in perspective, the wick device.
Figure 1:
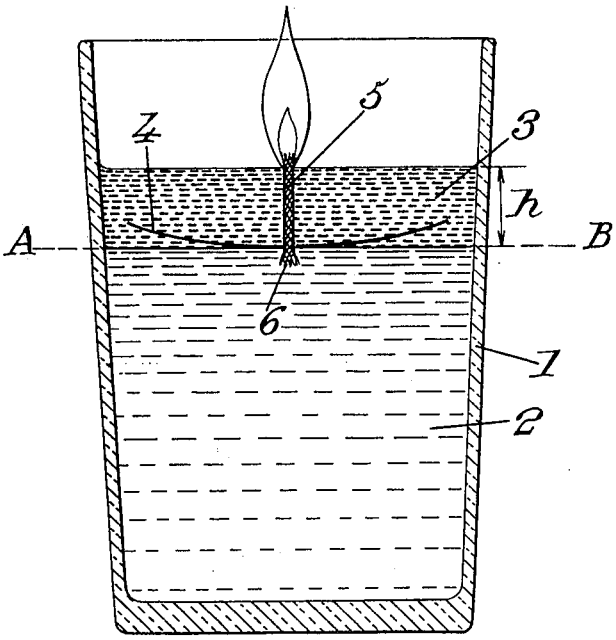
FIG. 1 is a vertical section of a lamp containing a layer of oil resting on a layer of water and comprising a wick device in accordance with the invention, the whole arrangement also being in accordance with the said invention.

To assemble the oil lamp of FIGS. 1 and 2, a layer 2 of water or other incombustible liquid is poured into a vessel 1, the upper part at least of which is made of a transparent material (glass, plastics material), and a layer of oil 3 of height $h$ is poured on top of said layer 2. A light float 4 is placed at the interface AB between these two layers, which float 4 supports at least one wick 5 whose initial length is slightly greater than the afore-mentioned height $h$, the said wick being suitably secured to the float so that it points vertically once the float is in place.

The float 4 is advantageously in the shape of a cup or spherical calotte of relatively large radius and is preferably made of a transparent material (particularly plastics material) so that when in place it is invisible from the outside.

As hereinbefore mentioned, this shape of cup avoids the formation of bubbles.

Furthermore, in practice it is found that the float is perfectly stable at the interface AB, which would appear to be partly due to the surface tension effect of the liquids.

Any suitable means such as gluing or other methods may be used to secure the wick 5 to the base of the calotte 4. However, the wick is advantageously passed through the calotte via a suitable hole which is sufficiently narrow to grip the base of the wick or wicks.

In this embodiment the base 6 of the wick projects beyond the calotte 4 so that in the position of assembly ensuring that the calotte floats at the level of the interface AB, the said base projects into the water.

As previously mentioned, the effect of this is to ensure the automatic extinction of the flame towards the end of the combustion of the layer of oil which normally feeds the wick, whereas at the end of combustion water is no longer prevented from rising up the wick from the base 6 thereof, following which the flame extinguishes without any danger of spontaneous ignition of the last traces of oil by carbonization of the wick and the resultant damage to the float.

The movement of these last traces of oil from the point when the oil level reaches the level of the edge of the calotte 4 is generally ensured by capillary action, but it may be facilitated by the presence of additional holes 7 provided around the central hole through which the wick passes. These holes may be made by suitably cutting out the central hole through which the wick passes so as to form edges or ridges which tend to penetrate the textile material of the wick and thus keep it in place.

It follows that regardless of the embodiment adopted, lamps of the type in question may be provided, which operate as follows.

At the start, with the glass 1 partially filled with water, a layer of oil of suitable height h less than the length of the wick is poured on top of the water and the float is then immersed in the layer until it just rests on the interface between the two liquids. The float stays in this position largely due to the surface tension forces.

Once the wick is lit it burns slowly and the oil is consumed at the same time until, as mentioned above, the water starts to rise up the wick once almost all the oil has been used up. Extinction of the flame is thus automatic and there is no danger of carbonization.

Such an arrangement is thus convenient in use and lends itself to various interesting decorative effects, especially as the float 4 is invisible and the flame thus appears to be suspended above the level of the oil. Any other applications are of course possible.

Various modifications may be made within the scope of the appended claims. In particular, it is apparent that the lamp may be sold without the oil and water and that, furthermore, the wick may be obtained separately and/or may be cut to appropriate size by the purchaser. The invention includes as one aspect a kit of parts comprising a container, a float and, optionally, a wick, the kit containing instructions, or being sold together with instructions for the arrangement of the parts together with oil and incombustible liquid to constitute a lamp as described above.

I claim:

1. An oil lamp comprising a container containing a layer of oil on top of an incombustible liquid, and at least one float in which is fitted at least one upstanding wick, wherein each float rests continuously on the oil-incombustible liquid interface regardless of the depth of the oil layer or complete submergence of the float in the oil, each wick having an initial length which is greater than the depth of the layer of oil so that in the floating position the said wick emerges directly from the surface of said layer.

2. A lamp according to claim 1, wherein the float is of dished shape.

3. A lamp according to claim 1 wherein the float is of transparent material.

4. A lamp according to claim 1 wherein the float is of plastics material.

5. A lamp according to claim 1 wherein the wick passes through the float into the incombustible liquid such that its base end is constantly in contact with the liquid.

6. A lamp according to claim 5, wherein the wick is secured by being gripped at the point where it passes through the float.

7. A lamp according to claim 1 wherein at least one hole is provided in the float close to the wick.

8. A lamp according to claim 7, wherein the float contains an aperture for the wick.

9. An oil lamp comprising, in combination, a container containing a layer of noncombustible liquid beneath a layer of combustible liquid of certain depth, and a light float element of such a form that it rests constantly in contact with the interface between the two layers regardless of the depth of the combustible layer and is maintained there by capillary forces, said element supporting a wick which passes through it in such a manner as to have its base constantly in contact with the incombustible liquid, said wick being, at least at commencement of combustion, of slightly greater length than the depth of the layer of combustible liquid so as to project slightly from the surface thereof.

10. An oil lamp as in claim 9 wherein the light float element is plastic and has the form of a shallow dish.

11. An oil lamp as in claim 9 wherein orifices are arranged in close proximity to a hole which is provided in the light float element for passage of the wick, to allow access of the last part of combustible liquid remaining between said light float element and incombustible liquid to the wick.

* * * * *